US007901004B2

(12) United States Patent
Figueras Mitjans

(10) Patent No.: US 7,901,004 B2
(45) Date of Patent: Mar. 8, 2011

(54) MOVABLE INSTALLATION COMPRISING ROWS OF SEATS

(75) Inventor: Jose Figueras Mitjans, Llica D'Amunt (ES)

(73) Assignee: Figueras International Seating, S.A., Llica D'Amunt (Barcelona) (ES)

( * ) Notice: Subject to any disclaimer, the term of this patent is extended or adjusted under 35 U.S.C. 154(b) by 42 days.

(21) Appl. No.: 11/908,638

(22) PCT Filed: Mar. 13, 2006

(86) PCT No.: PCT/ES2006/000117

§ 371 (c)(1),
(2), (4) Date: Sep. 14, 2007

(87) PCT Pub. No.: WO2006/097554

PCT Pub. Date: Sep. 21, 2006

(65) Prior Publication Data

US 2008/0164736 A1 Jul. 10, 2008

(30) Foreign Application Priority Data

Mar. 17, 2005 (ES) ..... 200500622

(51) Int. Cl.
*A47C 15/00* (2006.01)

(52) U.S. Cl. ..... 297/257; 297/232; 297/248

(58) Field of Classification Search ..... 297/232, 297/234–235, 239, 248, 257; 296/65.1, 65.13, 296/65.09; 244/117 R, 118.1, 137.1
See application file for complete search history.

(56) References Cited

U.S. PATENT DOCUMENTS

| | | | | | |
|---|---|---|---|---|---|
| 3,142,461 | A * | 7/1964 | Naylor | 244/137.1 |
| 4,000,586 | A * | 1/1977 | Vance et al. | 52/9 |
| 4,063,392 | A * | 12/1977 | Van Ryn et al. | 52/9 |
| 4,157,797 | A * | 6/1979 | Fox | 244/122 R |
| 4,294,048 | A * | 10/1981 | Sutter | 52/9 |
| 5,156,438 | A * | 10/1992 | Hayakawa et al. | 297/335 |
| 5,271,190 | A * | 12/1993 | Sugiyama | 52/10 |
| 5,280,987 | A * | 1/1994 | Miller | 296/65.03 |
| 5,529,185 | A * | 6/1996 | Alspach et al. | 206/386 |
| 5,529,378 | A * | 6/1996 | Chaban et al. | 297/331 |
| 5,559,411 | A * | 9/1996 | Winship | 318/466 |
| 5,575,389 | A * | 11/1996 | Alspach et al. | 206/386 |
| 5,711,505 | A * | 1/1998 | Nemoto | 248/424 |
| 5,800,015 | A * | 9/1998 | Tsuchiya et al. | 297/331 |
| 5,819,670 | A * | 10/1998 | O'Connor et al. | 108/48 |
| 6,086,018 | A * | 7/2000 | Gobeil et al. | 244/122 R |
| 6,199,325 | B1 * | 3/2001 | Winship | 52/10 |
| 6,199,951 | B1 * | 3/2001 | Zeile et al. | 297/341 |
| 6,474,245 | B2 * | 11/2002 | Richard | 108/54.1 |

(Continued)

FOREIGN PATENT DOCUMENTS

ES 2016896 YA 12/1990

(Continued)

*Primary Examiner* — David Dunn
*Assistant Examiner* — Ericka Garrett
(74) *Attorney, Agent, or Firm* — Lucas & Mercanti, LLP

(57) ABSTRACT

The invention relates to a movable installation comprising rows of seats. The inventive installation is formed by guides (1) which are housed in the ground and on which the rows of seats (2) are slidably mounted such that they can slide between a position in which they are grouped together and a position in which they are spaced apart. The aforementioned guides (1) define (i) upper extensions which provide a ground leveling reference during the assembly of the installation and (ii) a housing for the insertion of cover plates (10) which are level with the ground.

8 Claims, 19 Drawing Sheets

U.S. PATENT DOCUMENTS

| | | | | |
|---|---|---|---|---|
| 6,547,331 | B2 * | 4/2003 | Kunisawa et al. | 297/344.1 |
| 6,625,932 | B1 * | 9/2003 | Littlefield | 52/10 |
| 7,172,245 | B2 * | 2/2007 | Bouchard et al. | 297/217.7 |
| 7,419,205 | B2 * | 9/2008 | Tsukamoto | 296/65.03 |
| 2004/0051354 | A1 | 3/2004 | Bouchard et al. | |

FOREIGN PATENT DOCUMENTS

| | | | |
|---|---|---|---|
| ES | 1026421 | A | 4/1994 |
| ES | 1039056 | A | 10/1998 |
| ES | 1044216 | Y | 3/2000 |
| FR | 2528203 | A | 12/1983 |
| FR | 2634438 | YA | 1/1990 |
| FR | 2746435 | A | 9/1997 |
| GB | 677383 | A | 8/1952 |

* cited by examiner

MOVABLE INSTALLATION COMPRISING ROWS OF SEATS

FIELD OF THE ART

The present invention relates to adapting rooms or premises to be used in activities requiring an open space and activities in which an arrangement of seats to be used by the attendants is required, proposing an installation of rows of seats which allows moving such seats between a distribution in which they are spaced apart in order to be used and a position in which they are grouped together, leaving the surface of the premises open.

STATE OF THE ART

There are sites intended to be used on occasions for various activities in which sometimes open space with no obstacles is required, such as, for example, for practicing sports, while at other times an arrangement of seats to be used by the attendants is required, as in conferences or similar gatherings.

The conventional transformations of sites in this sense is based on using chairs which are arranged and removed according to if they are required in the site, this being a very cumbersome task due to the work required to arrange and remove the chairs and to store them, in addition to the fact that chairs suitable for this task are generally uncomfortable.

Solutions for installing seats that are movably assembled have also been developed, such that they movably slide on guides between a position in which they are grouped together for storage, leaving the surface of the site where they are used open, and a position in which they are spaced apart to be used, distributed on the mentioned surface of the site.

The solutions in this sense are complicated and expensive and involve a drawback which has not been satisfactorily solved, which is maintaining uniformity of the surface of the ground of the site on the sliding guides of the seats due to the difficulty of incorporating on said guides a stable cover duly leveled with the surface of the ground.

In addition, the sliding guides of the seats are housed in grooves of the ground, where it is difficult to achieve leveling the guides parallel with the plane of the ground, which is necessary for properly moving the seats on the guides and so that jams do not occur.

OBJECT OF THE INVENTION

According to the invention, an installation of rows of seats which are slidably arranged is proposed, whereby achieving very advantageous functional features with respect to the known assembly solutions for the same function.

The proposed installation consists of guides formed by grooved profiles which are embedded in the ground, which determining on the sides upper extensions the edge of which is level with the surface of the ground, which extensions form in the inner part a supporting step for a cover plate for covering the guide, incorporating rollably assembled bars on said guides on which bars the respective rows of seat are supported.

The support bars of the rows of seats are supported in the guides with rolling means incorporated in independent carriages or on characteristic formations of the bars, an adaptation of said arrangement being provided so as to allow the occupants of the following adjacent row of seats to introduce their feet, as well as to be able to couple lectern tables to be used by the occupants of the mentioned following adjacent row.

A simple assembly is thus obtained which allows moving the rows of seats for grouping them together in a storage position or placing them in the distributed use position, with features of the supporting means for supporting the seats that offer particular comfort qualities for use.

The housing of the guides of the movable assembly arranged level with the surface of the ground further facilitates installing the assembly and placing said guides level and parallel to the plane of the ground, whereby obtaining a perfectly sliding assembly of the rows of seats between the positions in which they are grouped together and in which they are used. An assembly embodiment is provided which facilitates the positioning of the guides in said level arrangement with the ground by means of regulation with disposable screws.

In addition, the shaping of the guides determines therein a housing for placing the cover plates of said guides, facilitating the positioning of said cover such that it forms a perfect continuity with the surface of the ground of the premises. The cover plates of the guides can be linked to the rolling carriages bearing the rows of seats, with a lowering or elevation that can be manually or automatically actuated.

The positions of the rows of seats distributed for use are determined with distance spacers between the different rows of seats, to which end profile sections are used which are placed inside the sliding guides, where they form a seating facilitating the assembly, and said sections do not interfere with the position of the cover plates of the guides. When the cover plates of the guides are automatically actuated, they themselves can function as spacers, with an assembly of articulated connecting rods between the carriages of the rows of seats that they separate so as to elevate or lower said plates due to the movement of bringing the rows of seats closer together or separating them.

The mobility of the rows of seats can be power-driven by means of racks incorporated in the guides and motors in the rolling supports of the rows of seats, the necessary electrification being provided by means of direct current through the guides, remote control by radiofrequency or wiring running through the guides being provided for that purpose.

The arrangement of the sliding guides of the rows of seats is further susceptible of being incorporated on pivoted or rotating moving parts of the ground where they are used, which allows many possibilities for the practical adaptation of the installation in the areas where they are used.

Based on the preceding, said proposed installation has clearly advantageous features and is preferred in the application of adapting of premises with and without seats according to the activities to be carried out therein.

DETAILED DESCRIPTION OF THE INVENTION

Figure 1:
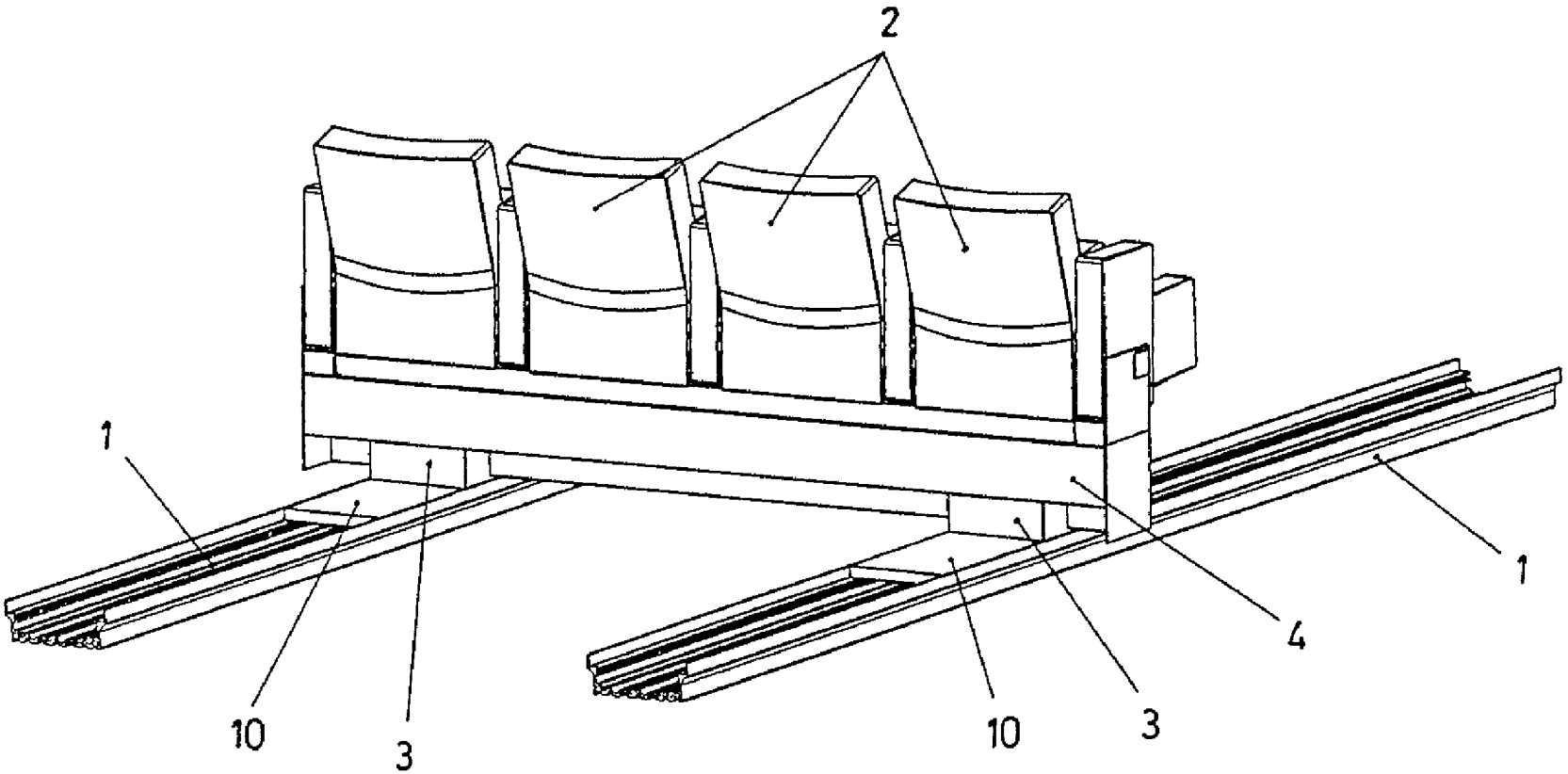
FIG. 1 shows a perspective view of a set of seats assembled on sliding guides according to the invention.
Figure 2:
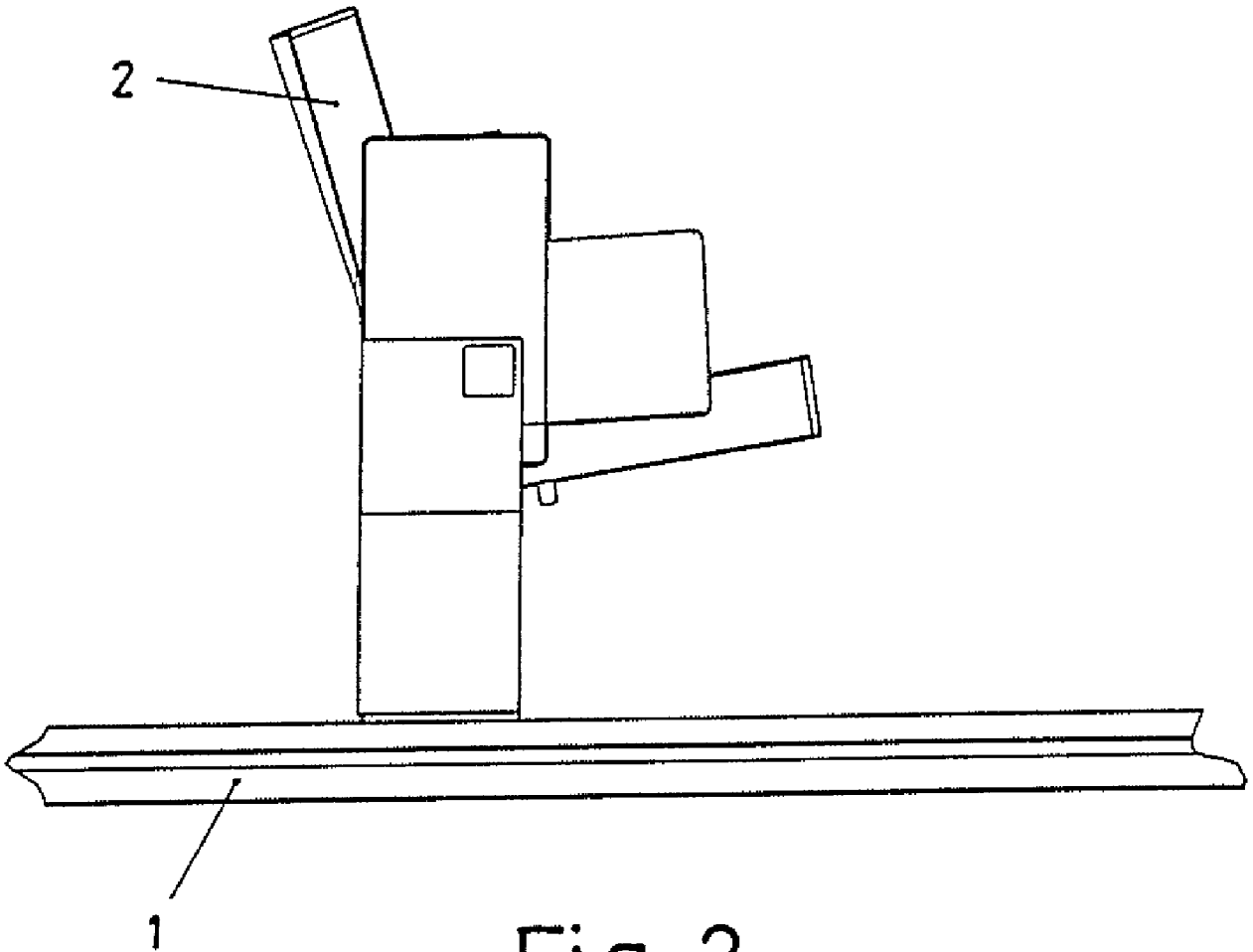
FIG. 2 shows a side view of the assembly of the previous figure.
Figure 3:
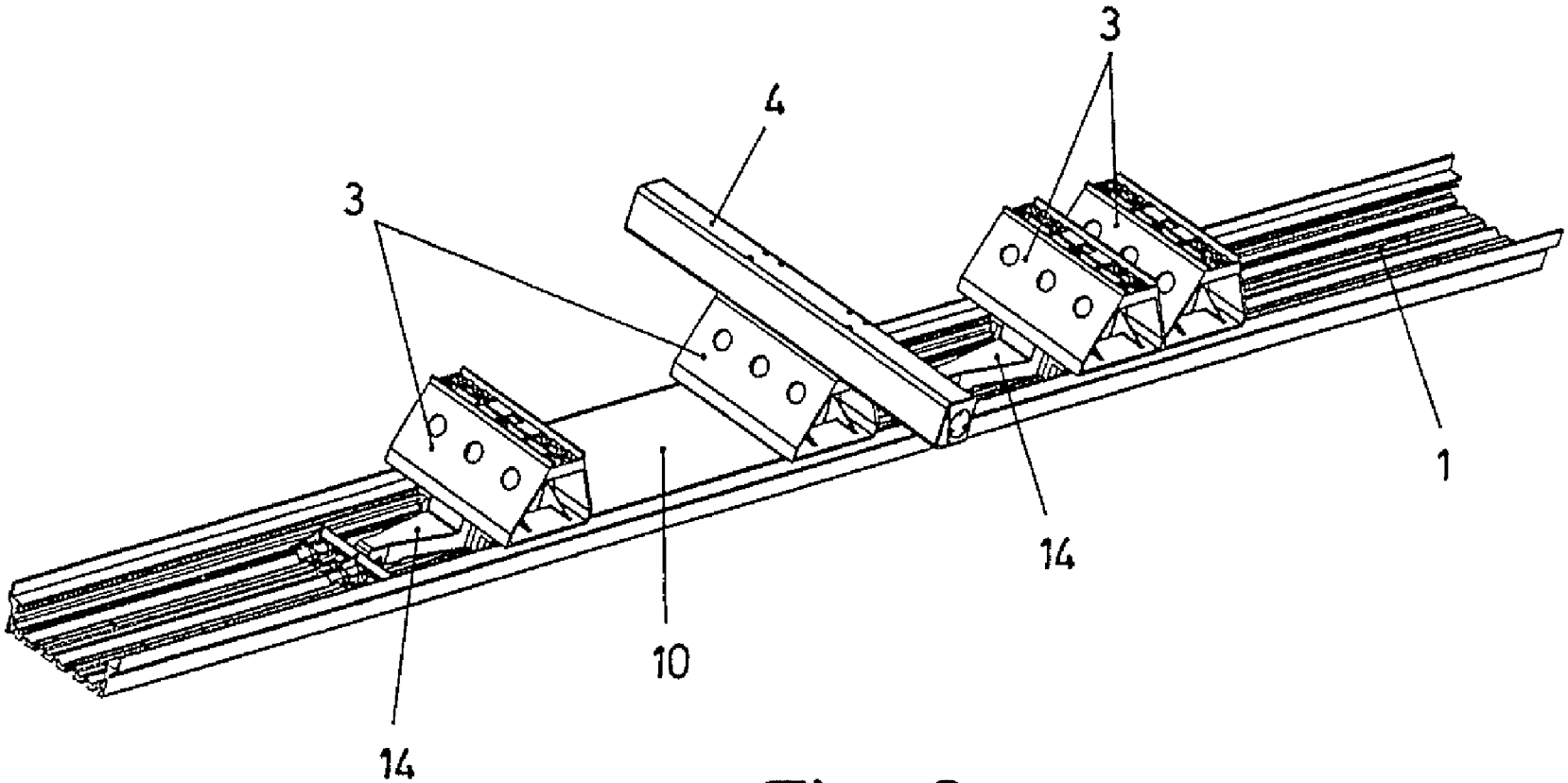
FIG. 3 shows a perspective view of the arrangement of a series of sliding supports for bearing several rows of seats, on a sliding guide.
Figure 4:
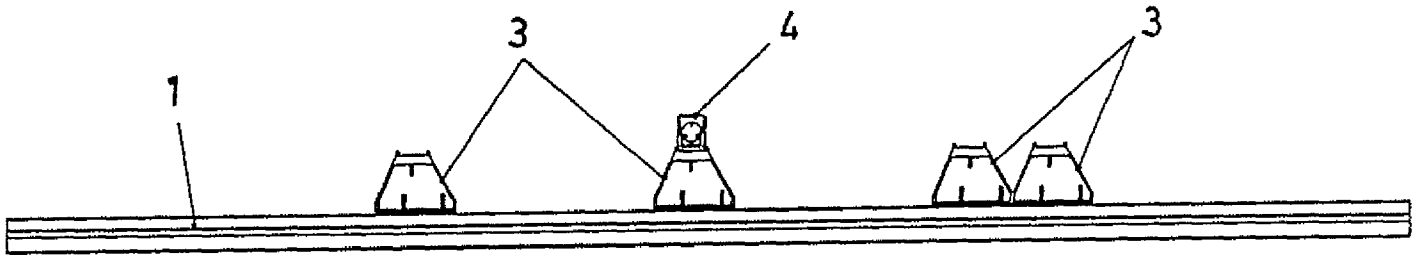
FIG. 4 shows a side view of the arrangement of the previous figure.
Figure 5:
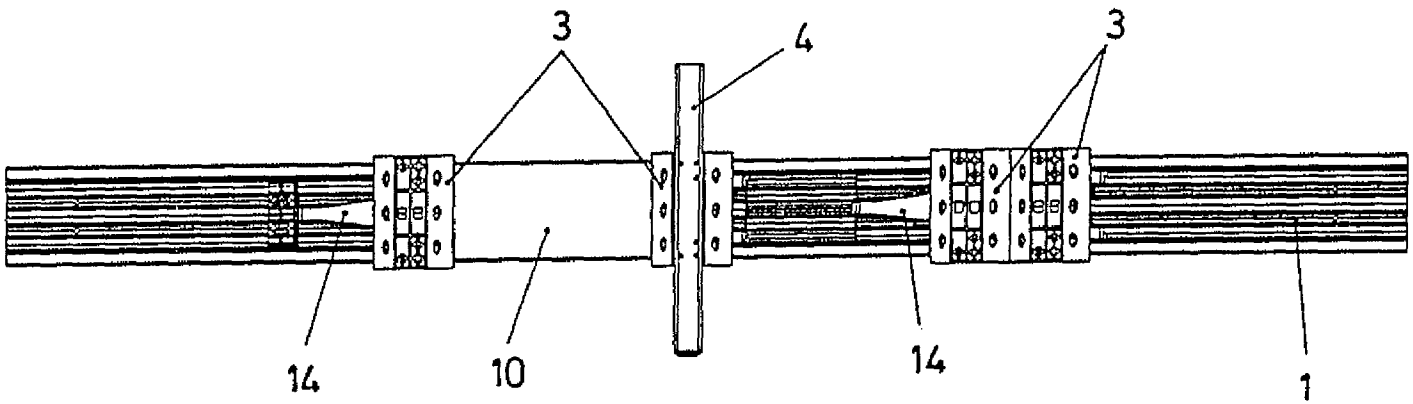
FIG. 5 shows a plan view in relation to the previous figure.
Figure 6:
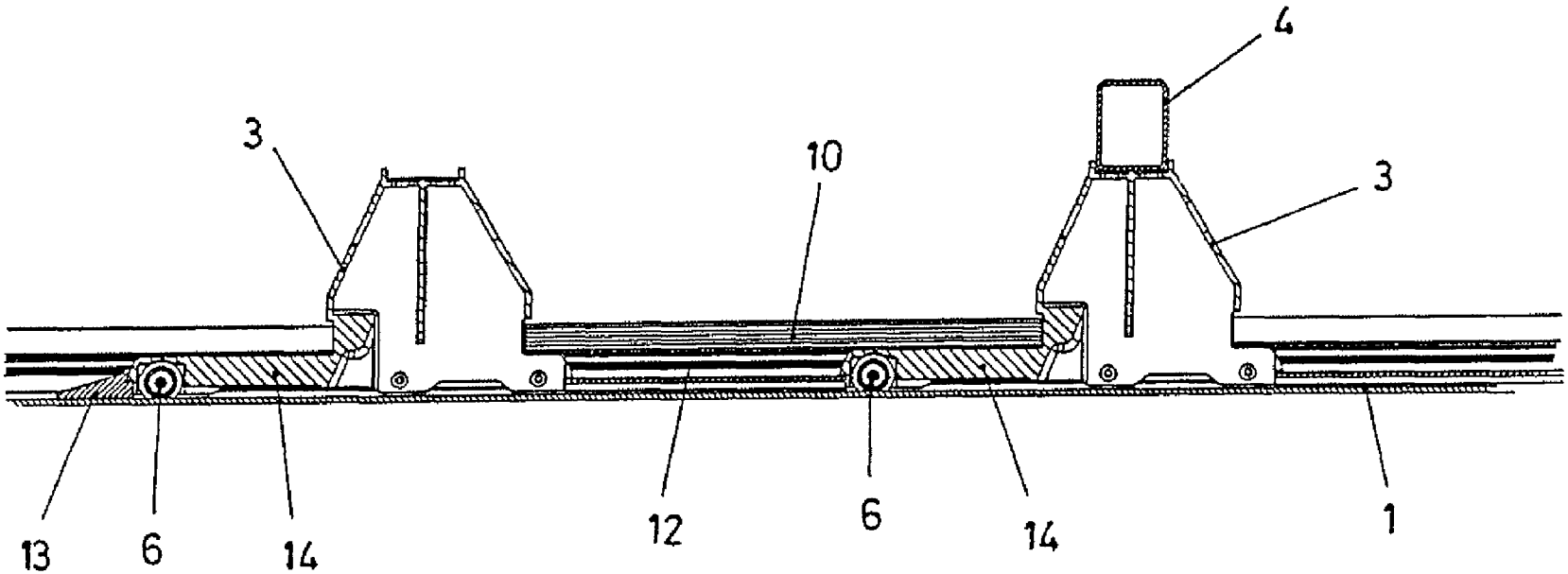
FIG. 6 shows an enlarged sectional detail of the arrangement of two supports for rows of seats on a sliding guide, in the position in which they are spaced apart such that the seats can be used.
Figure 7:
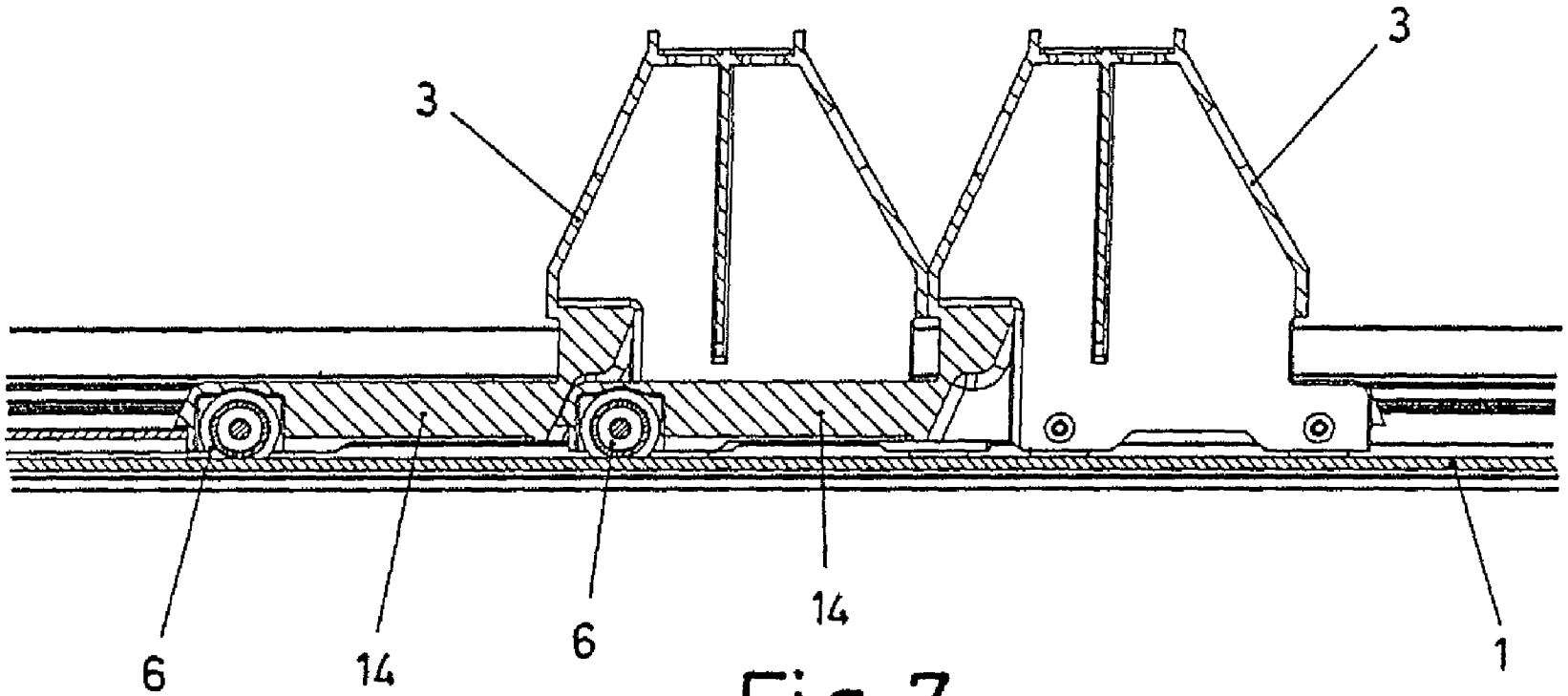
FIG. 7 shows an enlarged sectional detail of the arrangement of two supports of rows of seats on a sliding guide, in the position in which they are grouped together for storage.
Figure 8:
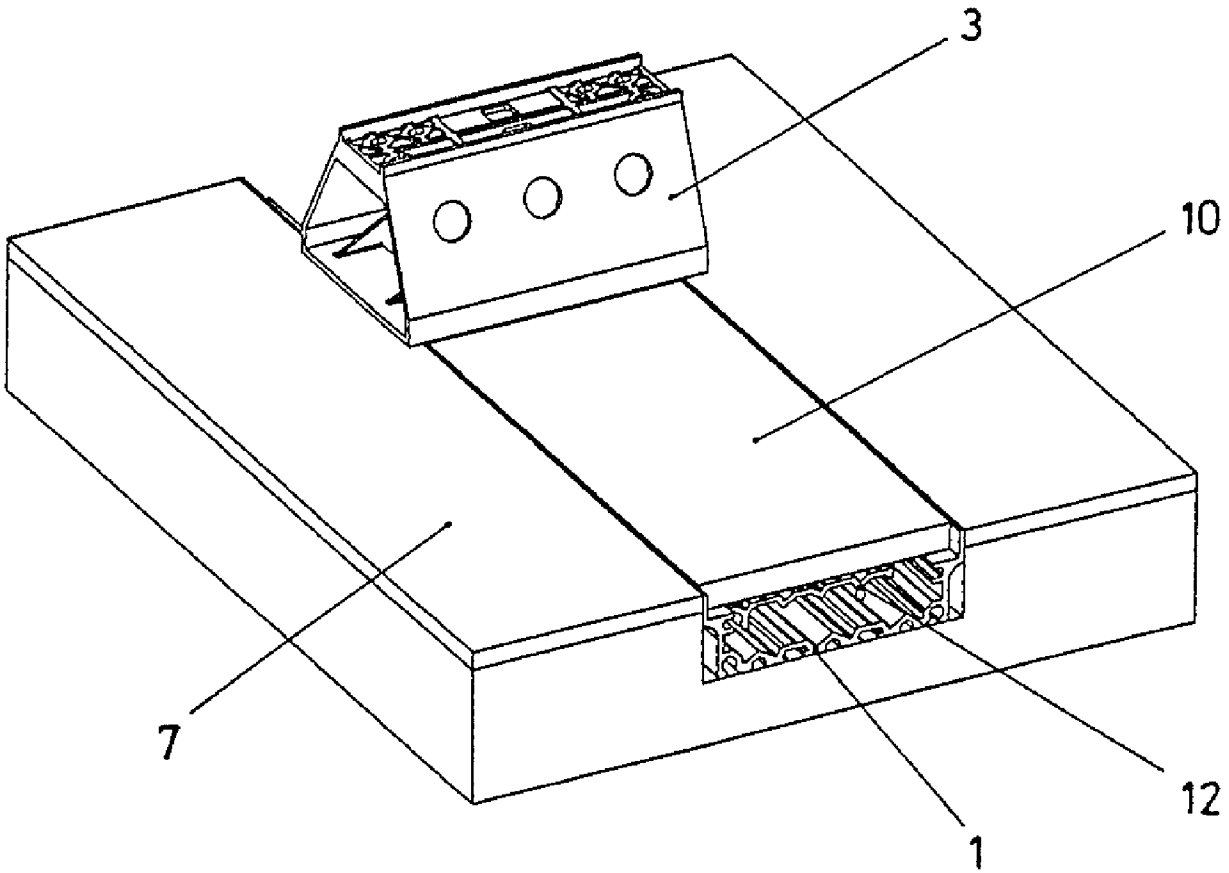
FIG. 8 shows a partial perspective view of the arrangement of a support of the rows of seats, on a guide housed in the ground and covered, arranged level therewith.

The object of the invention relates to an installation of rows of seats according to an arrangement allowing the sliding thereof between a position in which they are spaced apart so that they can be used and a position in which they are grouped together for storage, in order to be able to provide the premises where they are used with the rows of seats distributed therein or leaving the space thereof open and free of seats.

The installation comprises parallel guides (1) on which the rows of seats (2) are slidably mounted for sliding between the positions of being grouped together and spaced apart.

The assembly of the rows of seats (2) on the guides (1) is carried out by means of bearing supports (3) on which a bar (4) is incorporated on which the row of seats (2) is placed.

The supports (3) are reliably supported on the guides (1) as independent carriages on which the bar (4) is incorporated, or as shapings projecting from the bar (4), the guides (1) forming shapings by way of rails (5) on which said supports (3) are supported with wheels (6), facilitating the rolling movement. The rolling shapings (5) and the wheels (6) of the supports (3) form conjugated insertion forms, whereby preventing derailing during movement. On the sides, the guides (1) further form grooves (20) in which side rollers (21) of the supports (3) are inserted, aiding movement, while at the same time assuring stability of the supports (3) so as to prevent the possibility of tipping to the side.

The guides (1) consist of grooved profiles which are embedded in the ground (7) in the place where they are used, in which the guides (1) must be aligned in parallel to one another and level and parallel to the plane of the surface of the ground (7) so that the movement of the rows of seats (2) occurs with no difficulties.

Figure 9:
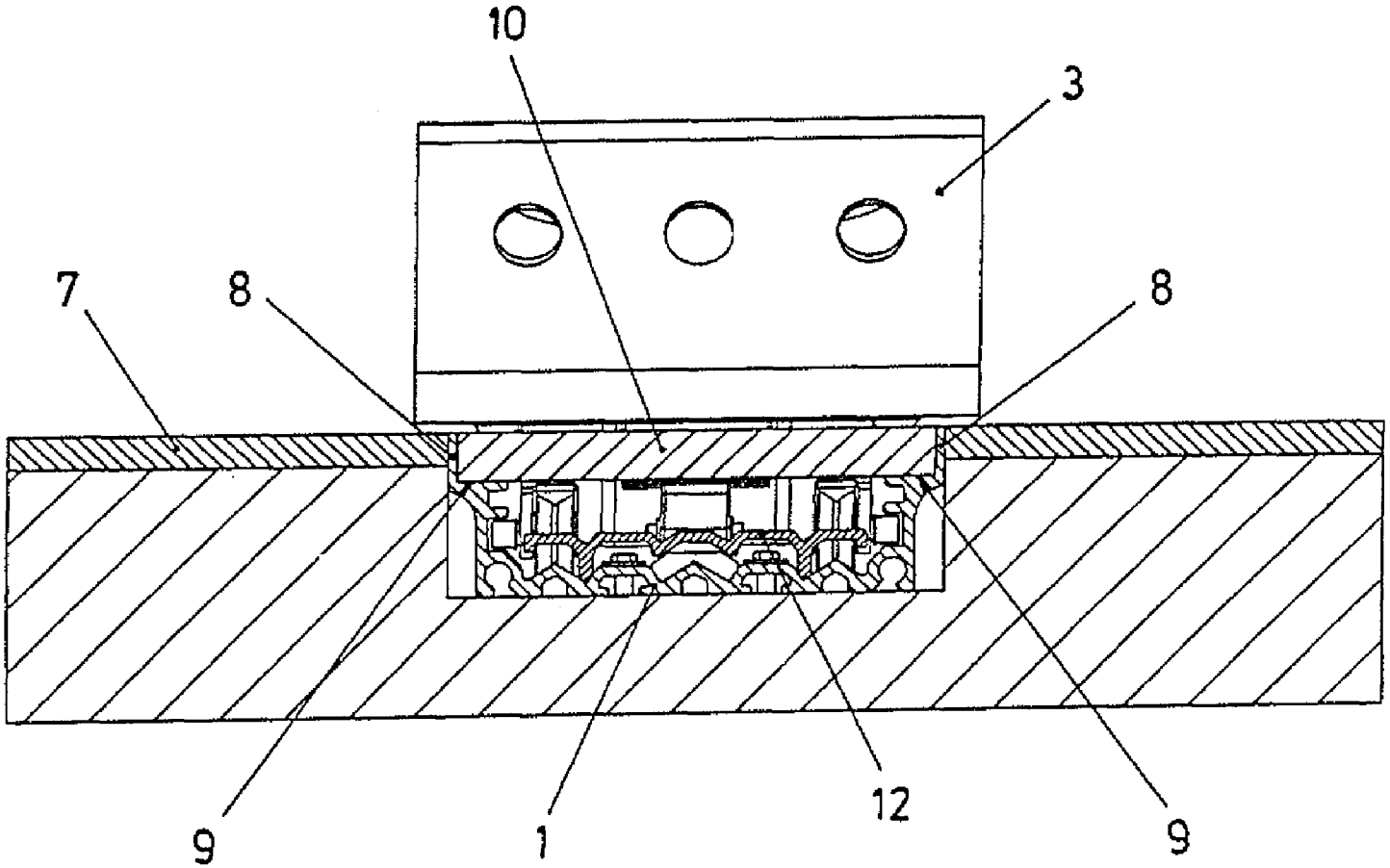
FIG. 9 shows a sectional front view of the arrangement of the previous figure.
Figure 10:
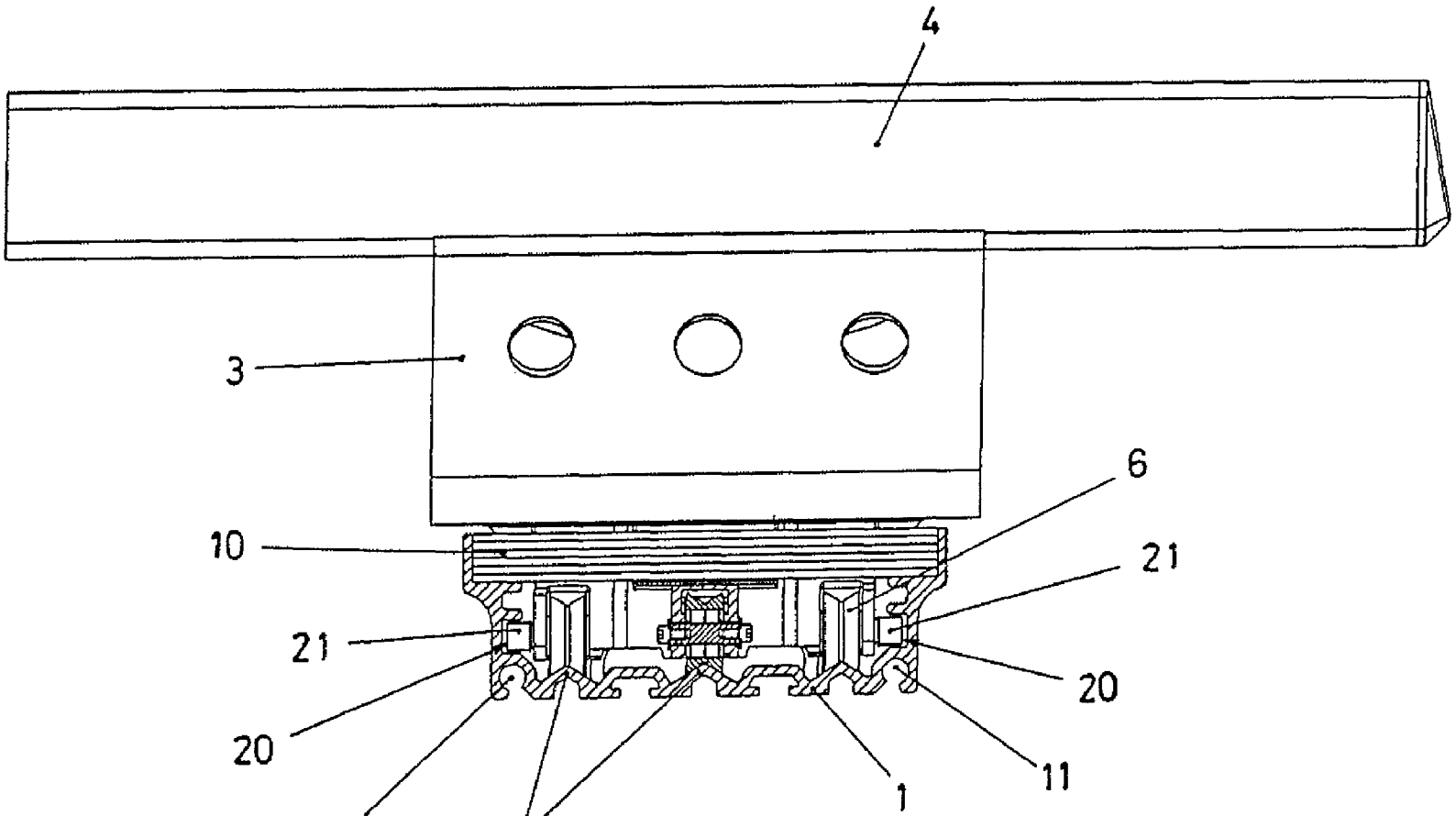
FIG. 10 shows a front view of the assembly of a support of the rows of seats on the sliding guide, cut away in the area of the rolling support on the guide.

To facilitate assembling the installation, the profiles of the guides (1) are provided, according to the invention, with upper extensions (8) of their sides by means of which they are level with the surface of the ground (7) in the arrangement of the assembly of the guides (1), as shown in FIG. 9, whereby making it easy to accurately arrange said guides (1), since by means of the extensions (8), it gives a good reference for determining the positioning in the installation.

An assembly embodiment is provided, according to FIGS. 11 and 12, according to which the guides (1) are secured to the bottom of the corresponding housing (22) by means of disposable screws (23), whereby the profile of the respective guide (1) is secured, regulating the position so that said profile is level and at the suitable height, such that when the cavity of the housing is later filled with a seating material (24) the mentioned profile of the guide (1) is permanently and stably fixed in the installation position.

The extensions (8) further form a step (9) in the inner part, a seating slot being defined between the steps (9) of both sides for placing cover plates (10) of the guides (1), such that the mentioned seating slot facilitates suitably placing said plates (10) to form a stable and even leveling in relation to the surface of the ground (7) in the place where they are used.

Plates (10) are provided for coving the guides (1), which plates have a length which coincides with the spacing of the rows of seats (2) for being incorporated between consecutive rows of seats (2) in the arrangement in which they are spaced apart, and longer plates (10) for being incorporated on the guides (1) when the rows of seats (2) are removed in the position in which they are grouped together, such that with said cover of the guides the surface of the ground (7) is, in either case, perfectly level, as if the guides (1) did not exist.

The cover plates (10) of the guides (1) between the rows of seats (2) when they are spaced apart can be independent so that they can be placed and removed as needed, an arrangement embodiment of said plates (19) being provided in which such plates are intended to cover the spaces between the rows of seats (2), articulated on the bearing supports (3) of the rows of seats (2), being able to pivot between a lowered position in the position in which the rows of seats (2) are spaced apart and an elevated position so as to be between the corresponding rows of seats (2) when the seats are grouped together.

In this embodiment, the plates (10) articulated on the supports (3) can be arranged to be manually lowered and elevated, having retaining latches in both positions.

An automatically actuated arrangement is also provided according to FIGS. 13 to 16, the mentioned plates (10) being articulated on the supports (3) of one of the rows of seats (2) and linked by means of connecting rods (25) with the corresponding supports (3) of the consecutive row of seats (2), whereby by means of the movement of bringing the rows of seats (2) close together and spacing them apart, the intermediate plates (1) are lowered and elevated.

The plates (10) can also be articulated on the supports (3) of each row of seats (2) independently of the consecutive row of seats (2), said plates (10) incorporating in the lower part a sliding or rolling cam to actuate, in combination with a ramp arranged at the entrance of the area for grouping the rows of seats (2) together, a pivoting elevation of the mentioned plates (10), due to the sliding movement of the corresponding row of seats (2).

In the described arrangement, the guides (1) can extend along the length and/or width of the premises where they are used, on the corresponding ground (7), by means of profile sections which are susceptible of being joined consecutively by means of rods inserted in housing cavities (11) forming the profiles of the mentioned guides (1).

Therefore, the assembly of the rows of seats (2) on the guides (1) allows sliding said rows of seats (2) so that they can be taken to a storage position, for example under a stage or any other suitable housing, for the purpose of leaving the space of the premises open for activities that require it, for example for practicing a sport; whereas for other activities in which seat arrangement is required, the rows of seats (2) can be taken to their distributed position in the premises.

The sliding of the rows of seats (2) can be done manually by means of being pushed by a person, and is also susceptible of being power-driven, for which purpose a non-limiting embodiment is provided, by means of racks in the guides (1) and drive motors in the bearing supports (3) of the rows of seats (2), with electrification by means of direct current through the guides (1) and remote control by means of radiofrequency or with the installation of wires running through the profiles of the guides (1).

The distribution of the rows of seats (2) in the position in which they are spaced apart so that they can be used is carried out with a certain spacing between the consecutive rows of seats (2), complementary elements (12) being used which are housed in the guides (1), by means of which the necessary spacing between the corresponding supports (3) is provided such that the consecutive rows of seats (2) are separated from one another in a fixed manner at the expected distance.

Said spacing elements (12) consist of profile sections comprising on their lower face shapings by way of flanges or ribs by means of which they are supported on the bottom of the guides (1), allowing the static positioning of these elements (12), functioning as stops for the supports (3) so as to keep the rows of seats (2) in a fixed position.

The housing of the mentioned spacing elements (12) inside the guides (1) further makes such elements (12) interfere only in the movement of the supports (3), without affecting the position of the cover plates (10) of the guides (1), therefore the placement of said plates (10) only requires inserting them in the housing defined by the steps (9), in relation to which the elements (12) are tucked in a lower level inside the guides (1).

When the cover plates (10) of the guides (1) between the rows of seats (2) are arranged to be automatically actuated by the movement of the rows of seats (2), as described above, the plates (10) can function as distance spacers between the rows of seats (2), without having to incorporate independent spacing elements (12).

Wedges (13) are placed in the guides (1) at the end parts of the rows of seats (2), by means of which wedges the last rows of seats (2) of the distribution are also locked on the guides (1), thus assuring the maintenance of the stability of the assembly of the distribution in the position in which they are spaced apart.

The bearing supports (3) of the rows of seats (2) have a lower extension (14) integral with the support base, whereby assuring the stable seating without the risk of tipping over, said supports (3) being accordingly provided with a lower cavity matching the mentioned extension (14), such that in the position in which the rows of seats (2) are grouped together, the supports (3) of each of them insert their projection (14) in respective cavity of the supports (3) of the following row of seats (2), thus allowing bringing the different rows of seats (2) close together in this position in which they are grouped together.

It is provided that the supports (3) can comprise a cavity in the rear frontal part that is above the guides (1) of assembly so as to allow the users of each row of seats (2) to place their feet in the supports (3) of the adjacent row of seats (2) in front of them, whereby favoring comfort in the use of the installation.

Figure 11:
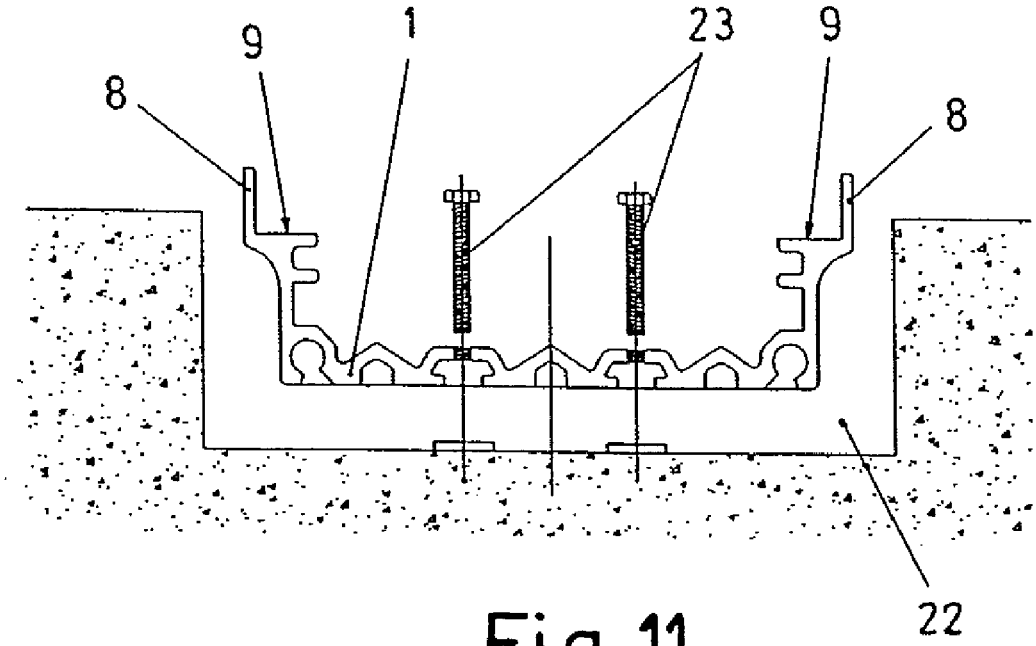
FIG. 11 shows a cross-section view of the arrangement of the assembly of a guide with regulation by means of disposable screws, before being secured.
Figure 12:
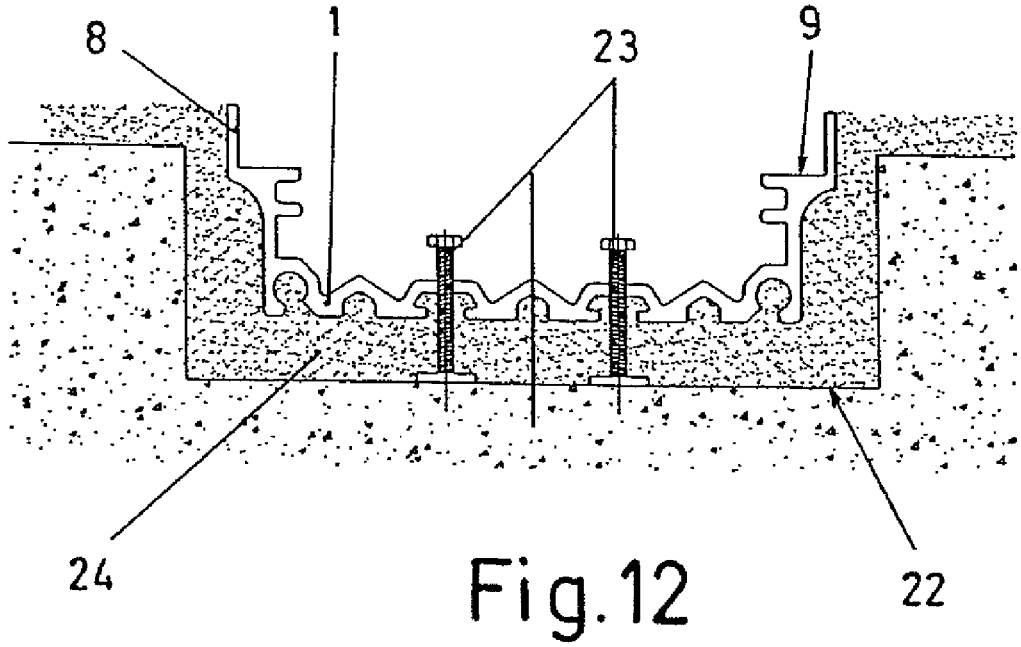
FIG. 12 shows a view of the previous arrangement in the position in which the area under the guide is filled with the seating materials.
Figure 13:
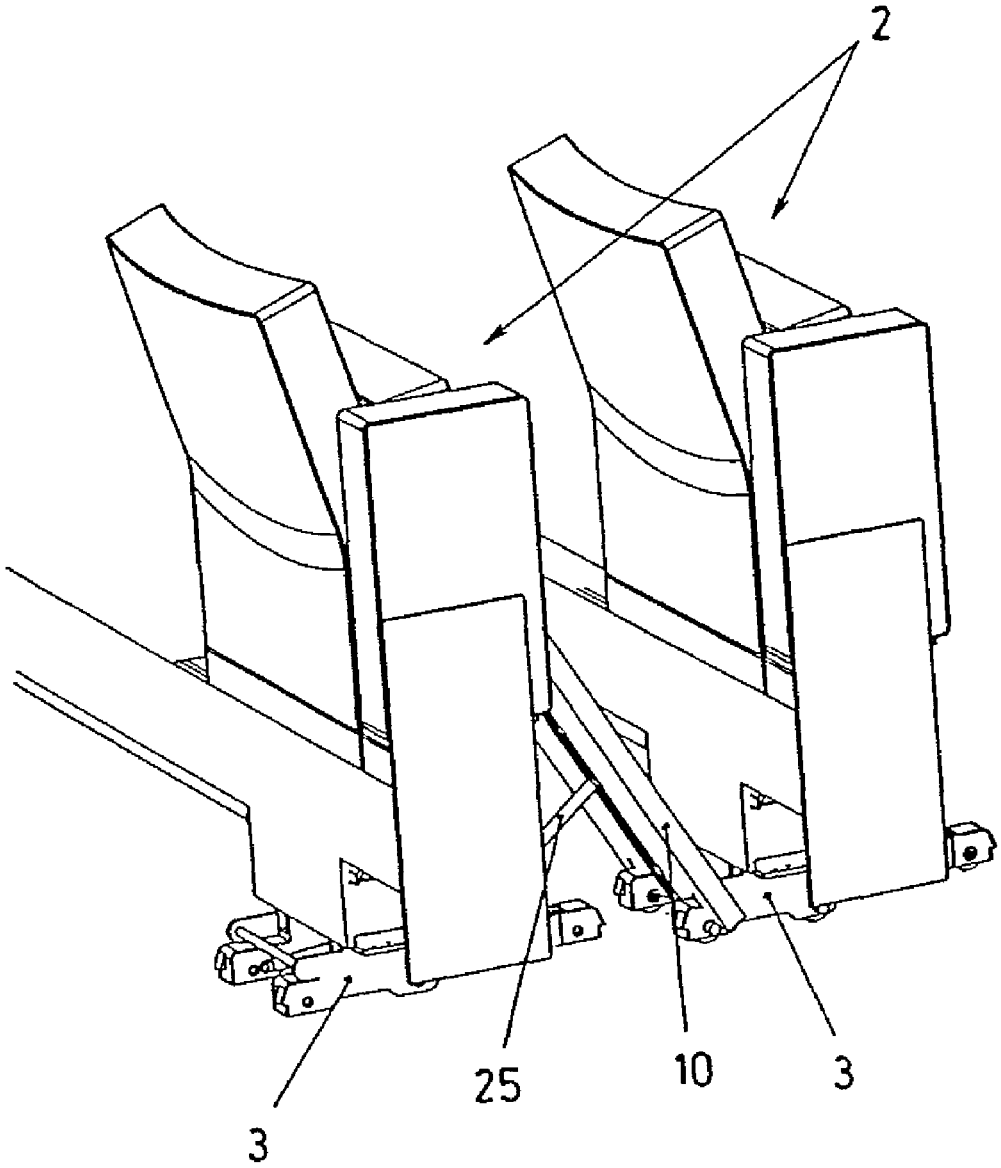
FIG. 13 shows a perspective view of two seats belonging to respective consecutive rows, with an automatically actuated arrangement of the cover plate of the corresponding guide.
Figure 14:
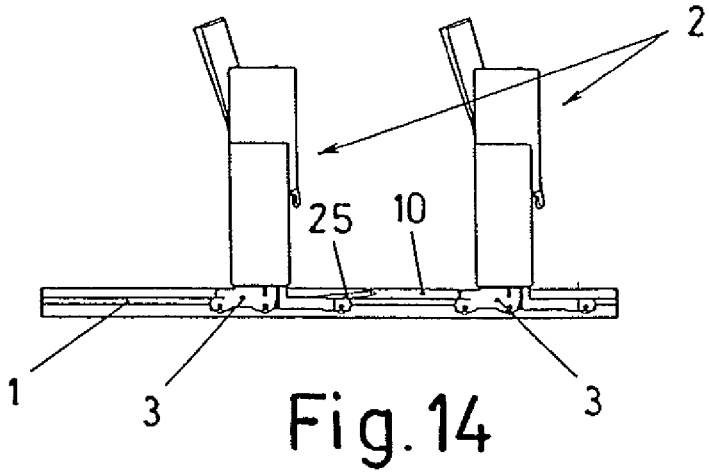
FIGS. 14, 15 and 16 show a side view of the previous assembly according to three successive positions from the position in which the rows of seats are spaced apart to the position in which they are grouped together.
Figure 15:
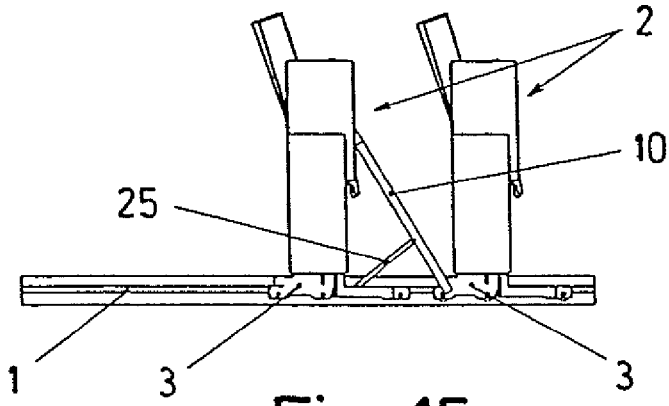
Figure 16:
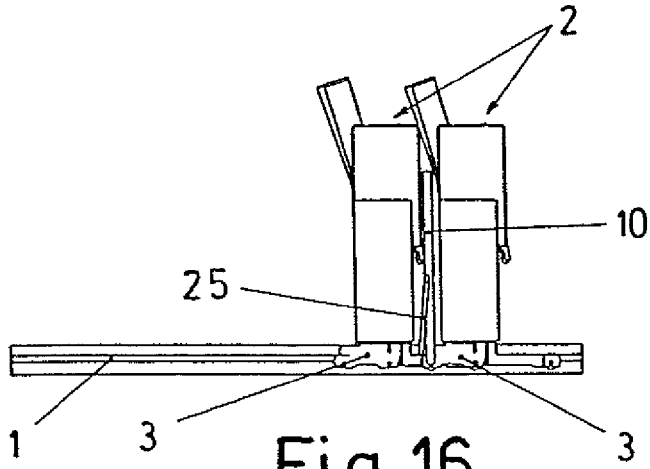
Figure 17:
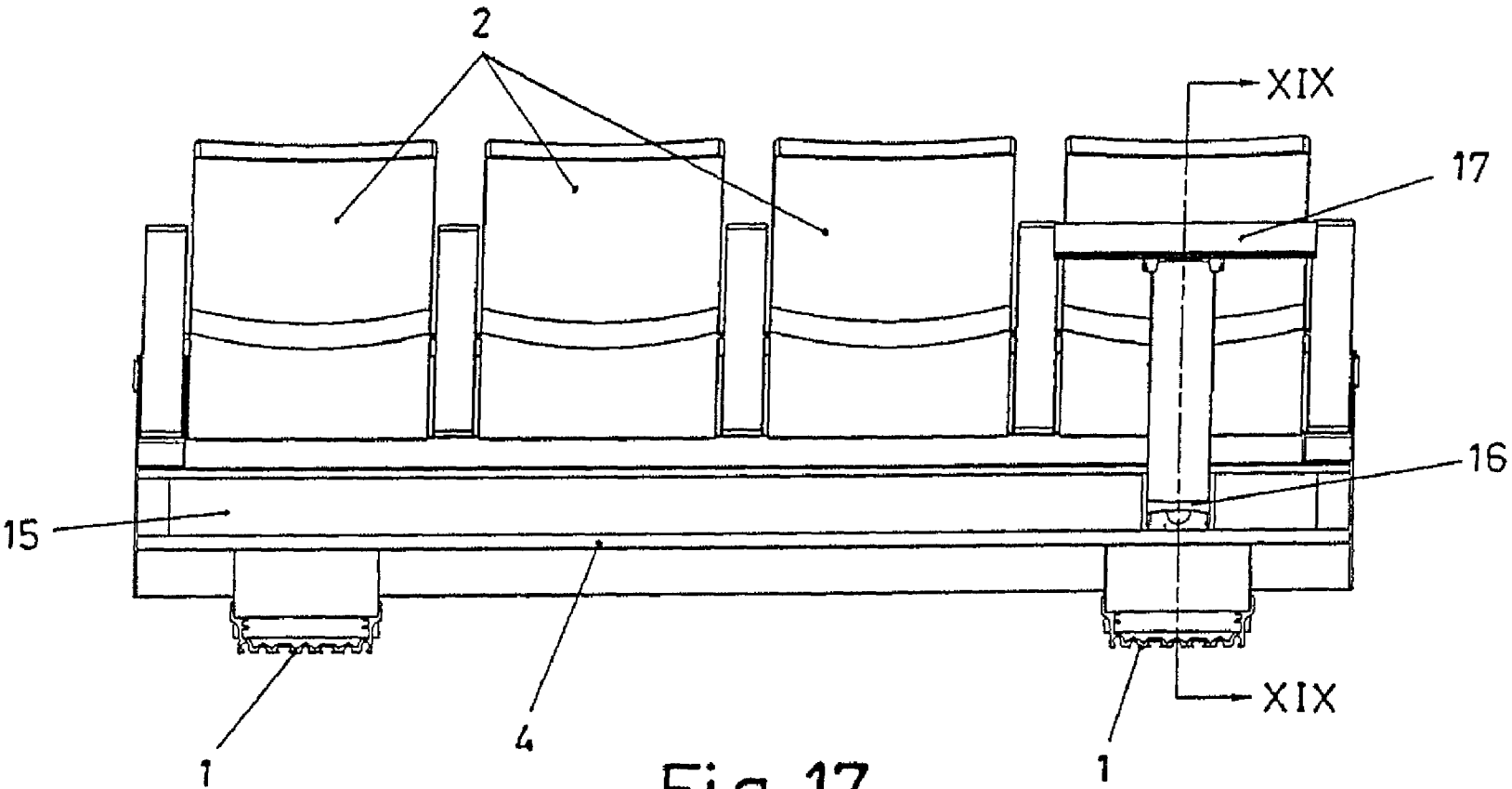
FIG. 17 shows a rear view of a row of seats assembled according to the invention, incorporating a lectern table behind one of the seats.
Figure 18:
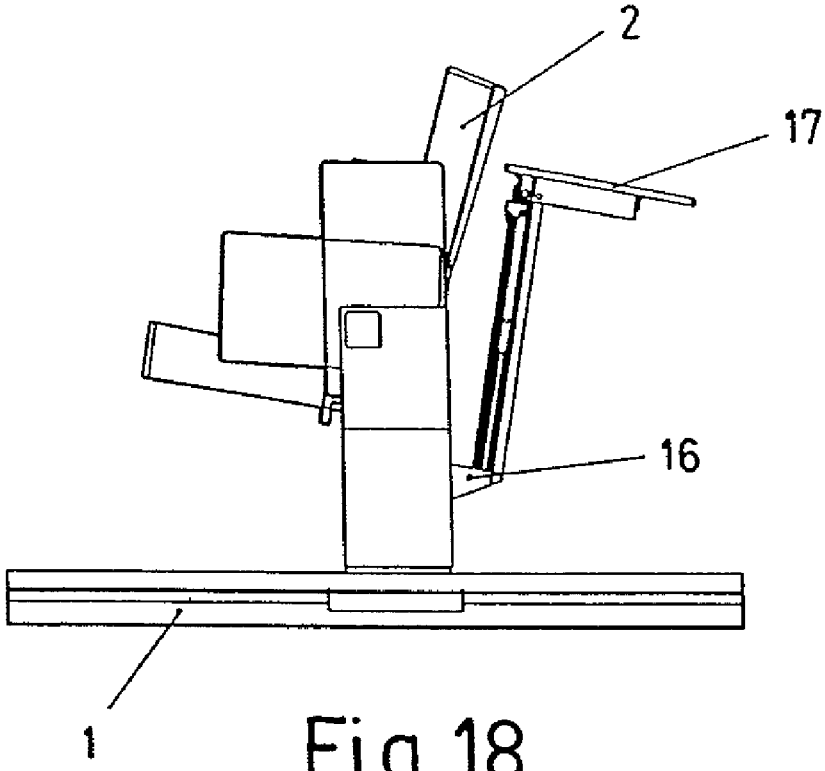
FIG. 18 shows a profile view of the assembly of the previous figure.
Figure 19:
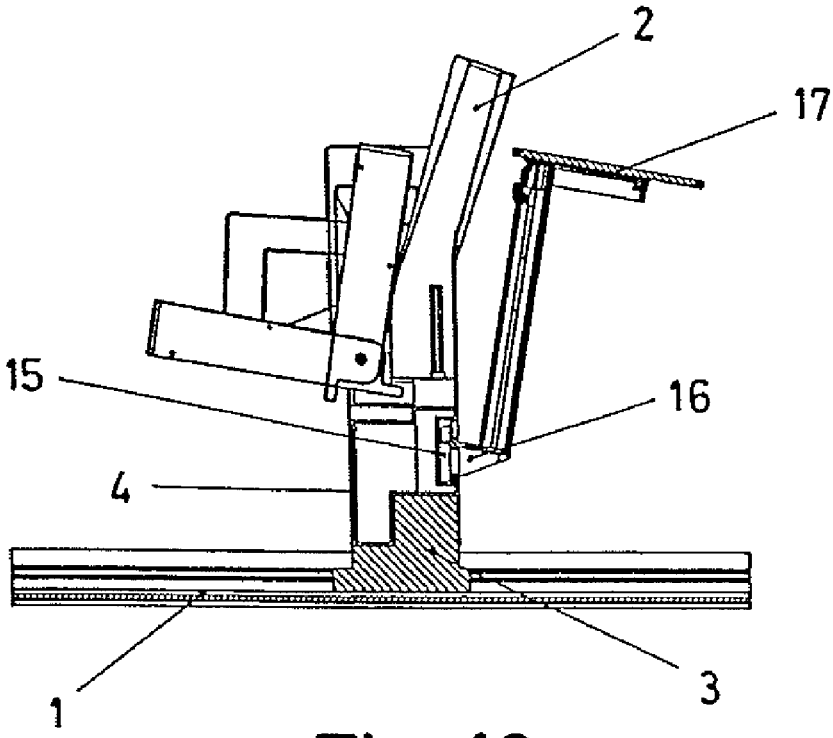
FIG. 19 shows a view according to section XIX-XIX indicated in FIG. 17.

The bar (4) for assembling the seats (2) is in turn provided with a rear housing (15) where supports (16) bearing lectern-type tables (17) can be coupled, as can be seen in FIGS. 11 to 13, thus benefiting the usefulness in using the installation with an additional feature. The lectern tables (17) can be provided with audio communication and lighting equipment, the electrical connection wires of which are passed through the column for bearing said tables (17) and through the corresponding supports (16).

The installation can be assembled in grounds (7) provided with moving parts, which allows adapting grouping the rows of seats (2) together in particular conditions so as to make better use of the places where they are used.

Figure 20:
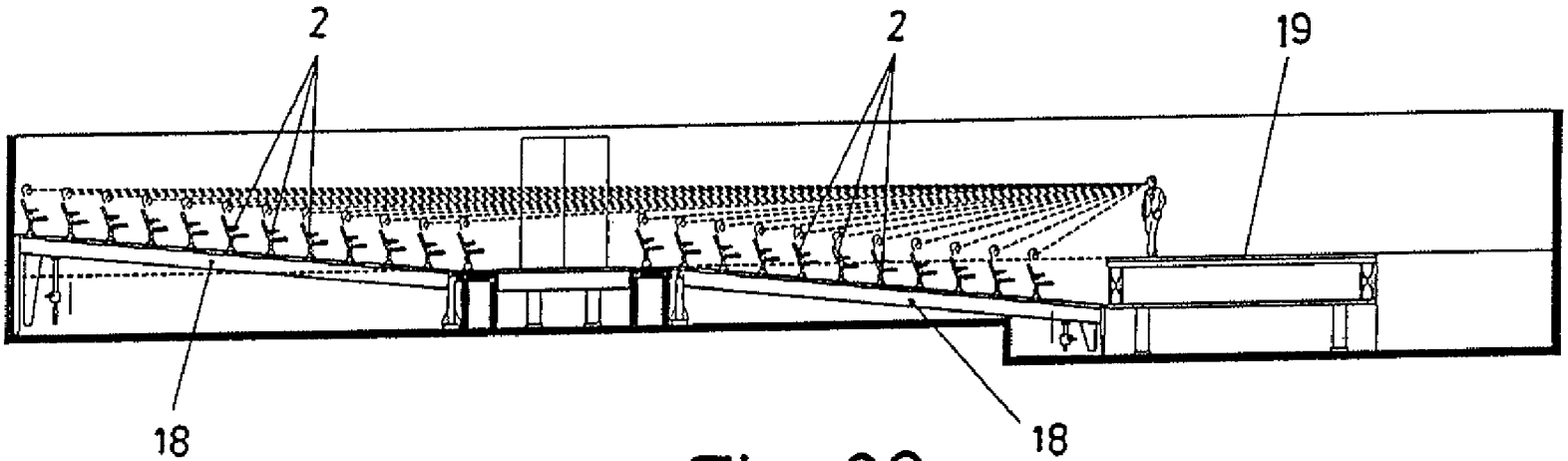
FIGS. 20, 21, 22 and 23 show different positions of an application of the movable installation of seats on pivoted ground parts.
Figure 21:
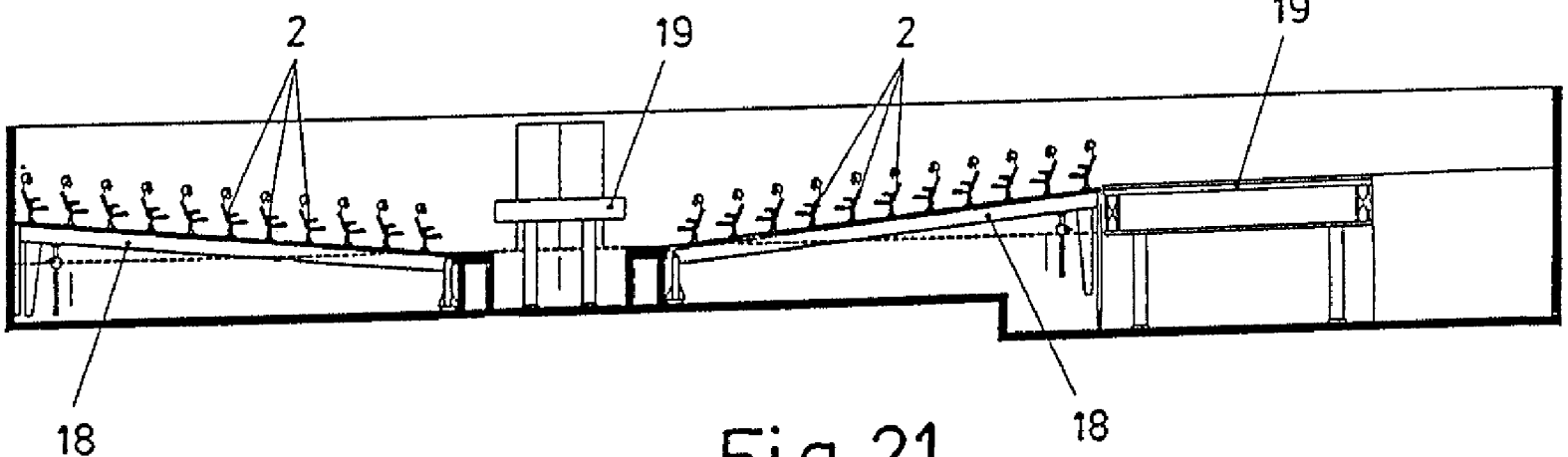

As a non-limiting example, the ground (7) where they are used can have pivoted areas (18), which areas can be inclined, as shown in FIGS. 20 and 21, such that the rows of seats (2) are in a descending position in relation to a point of observation, such as a stage area (19).

Figure 22:
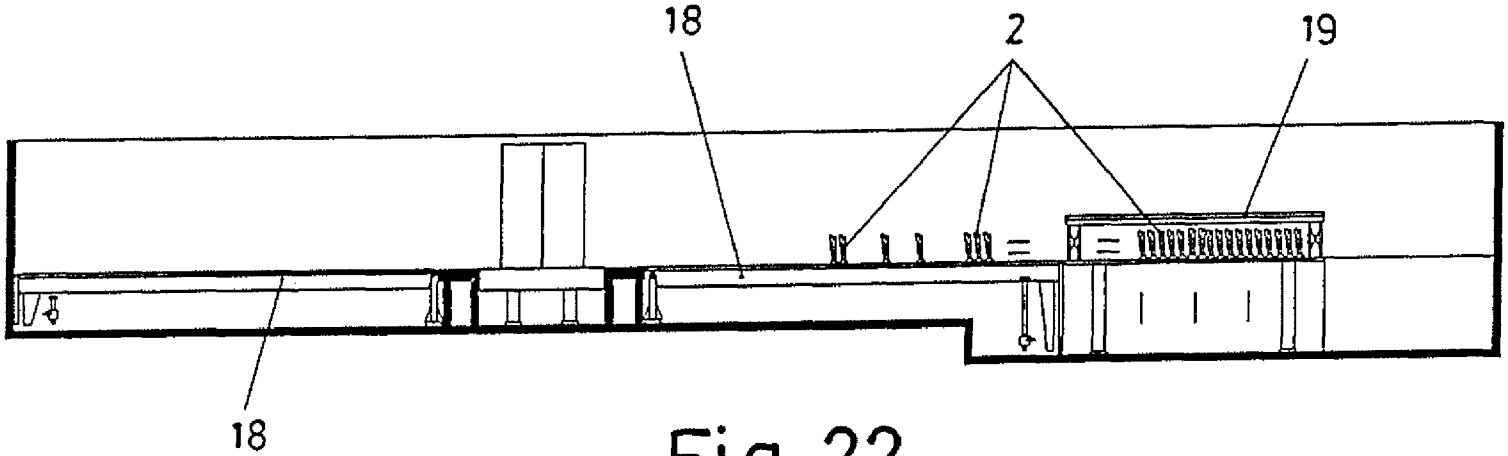
Figure 23:
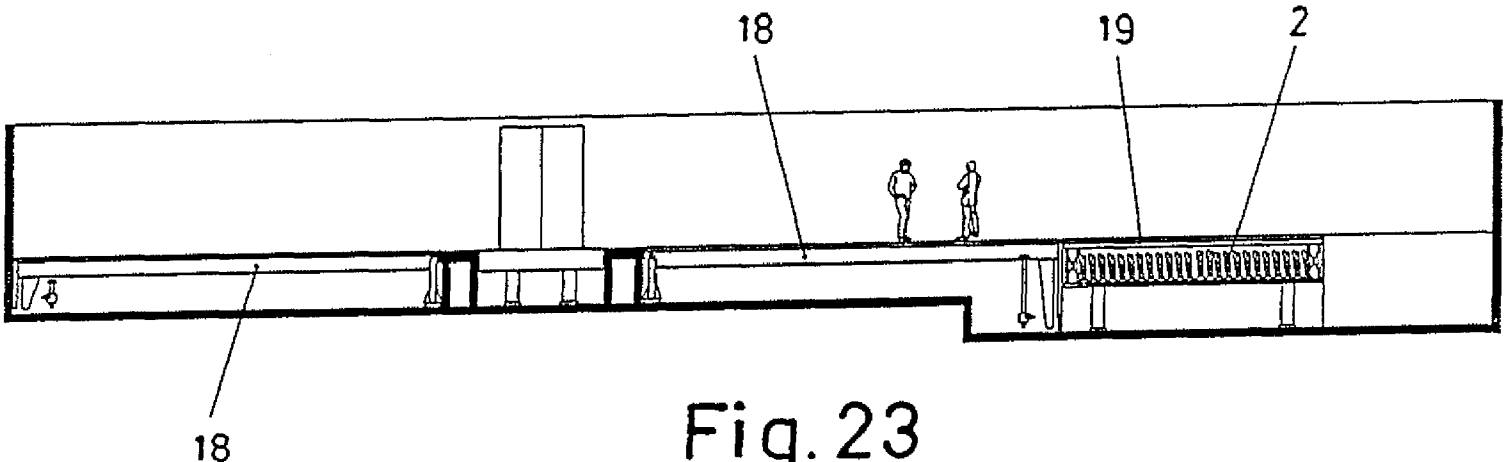

The arrangement of the assembly in pivoted areas (18) allows moving the height of the areas so as to place them horizontal to the ground level or in a lower position, such that in the lower position they allow grouping the rows of seats (2) together and spacing them apart by horizontal sliding in relation to a housing located under the ground, as shown in FIG. 22, whereas in the elevated position they allow forming a horizontal open ground when the rows of seats (2) are removed.

Figure 24:
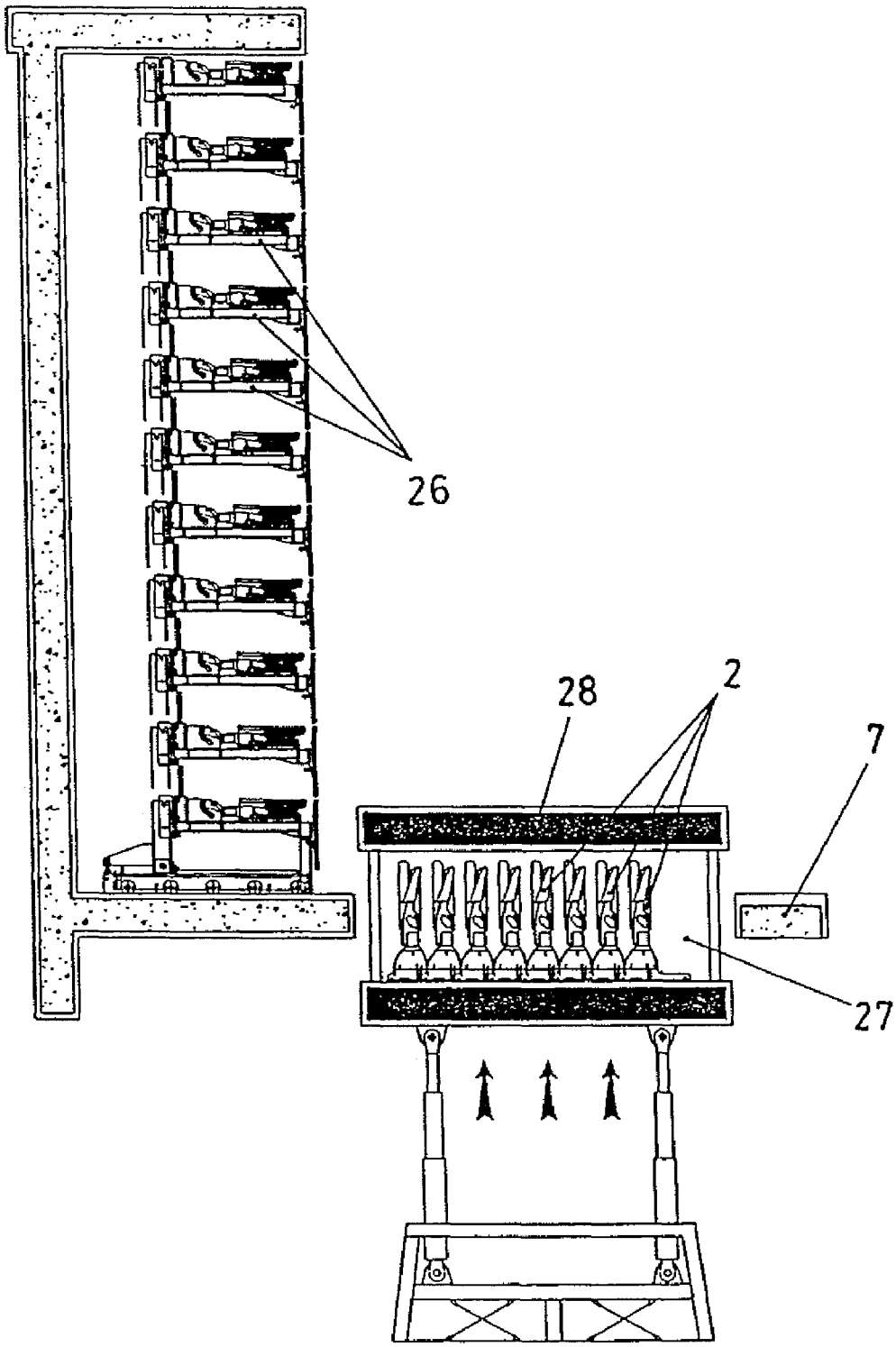
FIGS. 24 and 25 show an example of grouping the assembly of seats in a stepped distribution, in two positions of the sequence of spacing them apart.
Figure 25:
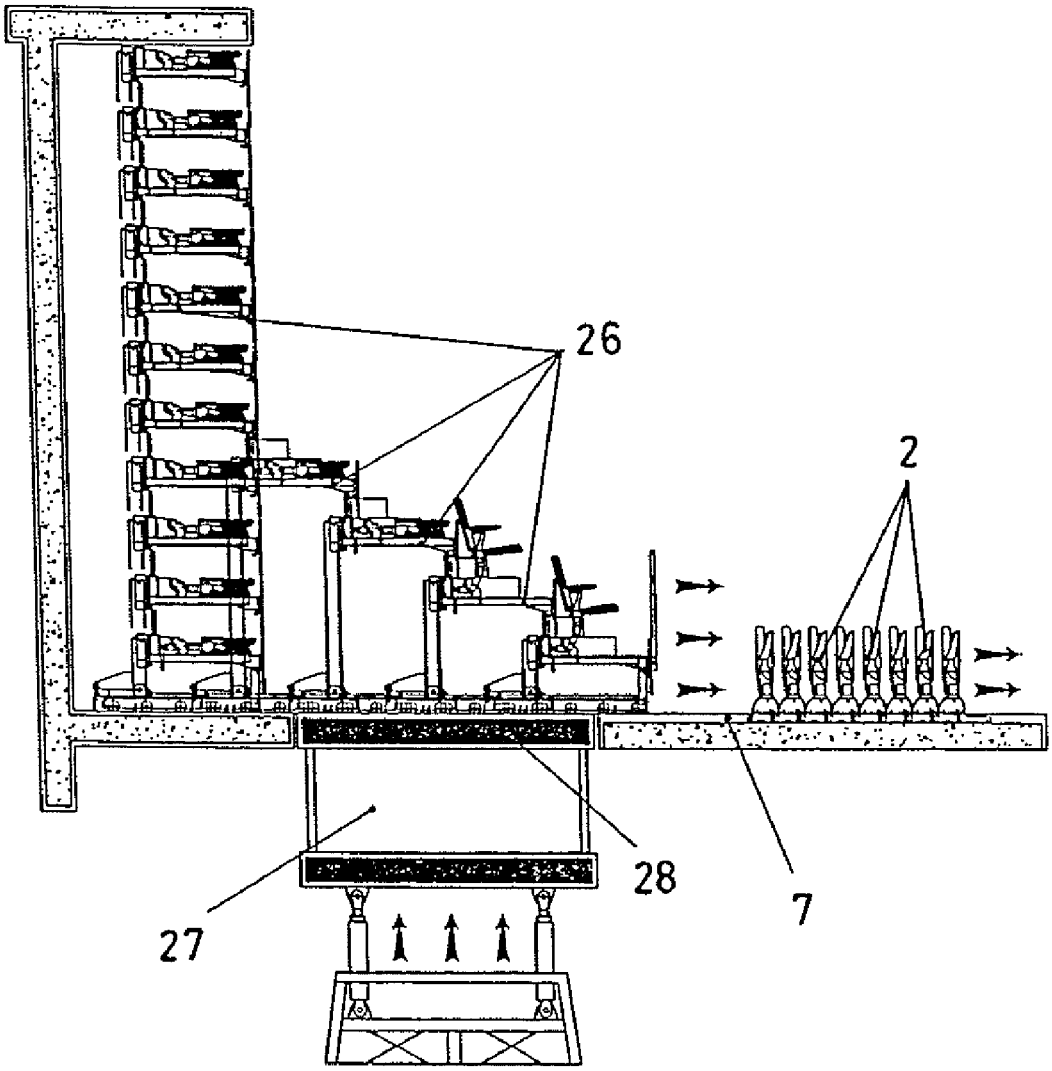

The rows of seats (2) can also be arranged on partial ground areas (26) in a stepped distribution, the partial areas (26) being movably assembled, with the rows of seats (2) being lowerably assembled thereon, such that the assembly of the partial areas (26) can be grouped together and spaced apart between a storage position and a use position, as shown in FIGS. 24 and 25, even being able to house the movable rows of seats (2) of the rest of the site in a premises (27) under a ground part (28) susceptible of elevation and lowering the place where the partial areas (26) are spaced apart.

Figure 26:
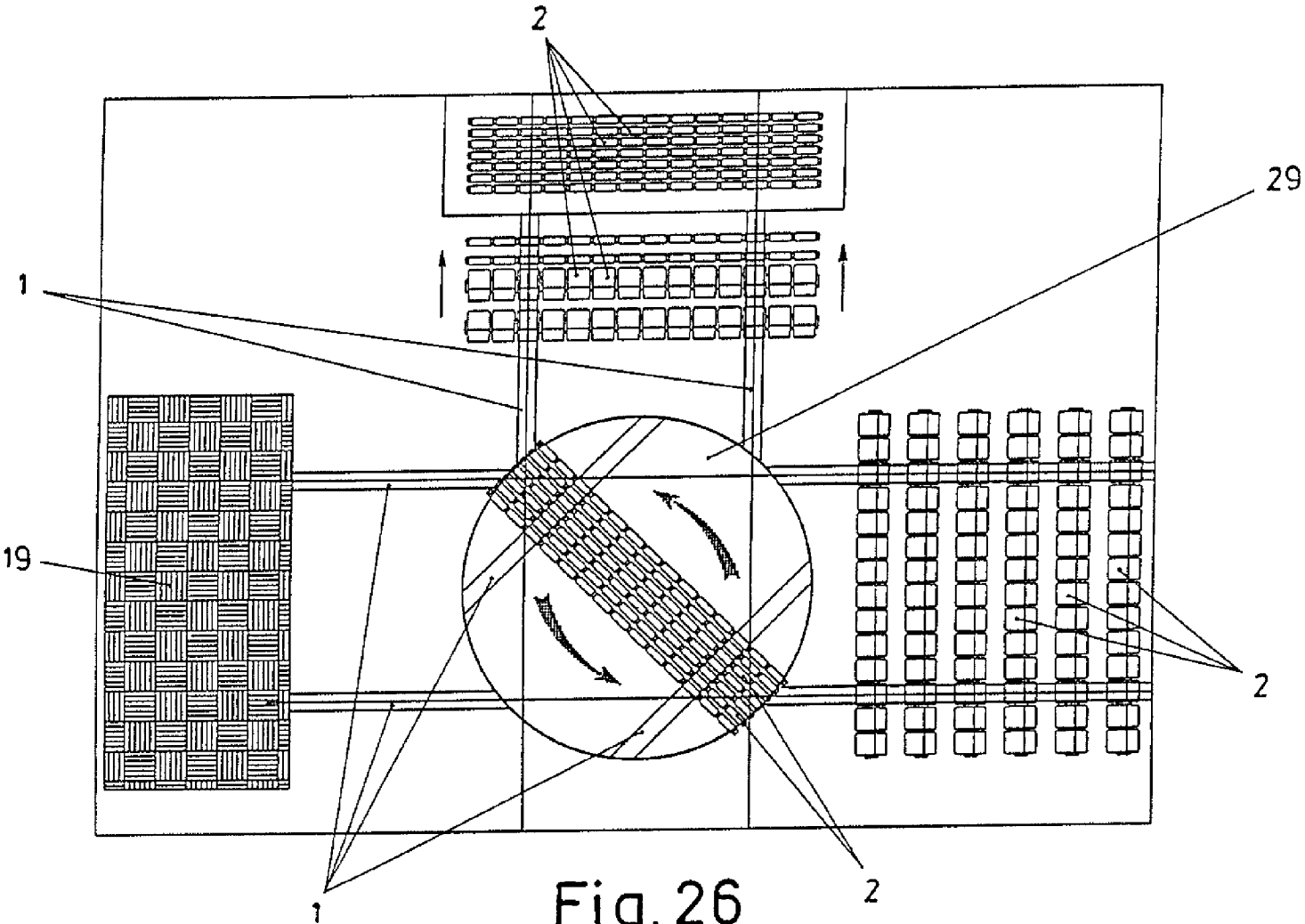
FIG. 26 shows a plan view of an arrangement of rows of seats on a ground with a rotating area for changing the orientation of the movement of the rows of seats.

The ground (7) where the movable rows of seats (2) are incorporated can further have rotating areas (29) by means of which the sliding direction of the row of seats (2) with respect to the perpendicular guides (1) can be changed, as shown in FIG. 26.

The invention claimed is:

1. A movable installation, comprising:

rows of seats;

each of the rows of seats mounted on a bar;

each bar transversely and slideably mounted on guides;

the guides housed in the ground;

each of the rows of seats slideable horizontally on the guides between a storage position where the rows of seats are grouped together for storage and a spaced position where the rows of seats are spaced apart and distributed throughout a premises;

each of the rows of seats parallel to one another and positioned consecutively one of the rows of seats behind another of the rows of seats in a same plane in the storage position, the spaced position and during movement between the storage position and the spaced position, the same plane parallel to the ground;

each of the guides are U-shaped profiles provided with extensions extending upward from sides of the guides, and the extensions are positioned level with a surface of the ground upon assembly of the installation in the ground; and wherein the extensions form a step on top of the sides of the guide, adjacent to the extensions, on inner parts of the guides, a slot housing being formed between the step of both sides for incorporating a cover of the guides by means of plates which are level with the ground.

2. The movable installation according to claim 1, wherein cover plates for the guides are arranged and extend between the rows of seats, the cover plates are articulated on a bearing means of one of the rows of seats and related by connecting rods to the bearing means of the rows of seats subsequently following for elevating and lowering the cover plates due to movement of bringing the rows of seats closer together and separating the rows of seats.

3. The movable installation according to claim 1, wherein the bar is supported with respect to the guides by supports that are integral with or complementary to the bar.

4. The movable installation according to claim 1, wherein a plurality of spacing elements are housed inside the guides and profile sections are formed on inner faces of the spacing elements which are seated on the guides to form a locking connection between supports of the rows of seats and the guides for separation and immobility thereof in the spaced position.

5. The movable installation according to claim 1, wherein movement of the rows of seats if power-driven by racks arranged in the guides and drive actuators incorporated in supports, corresponding electrification being provided through the guides, with remote control by radiofrequency or wiring through the guides.

6. The movable installation according to claim 1, wherein the guides are partially incorporated on pivotable parts of the ground.

7. The movable installation according to claim 1, wherein the guides are partially incorporated on rotatable parts so as to change orientation of the rows of seats.

8. The movable installation according to claim 1, wherein the guides are housed in a cavity and secured with disposable screws, by means of which height and level position is determined, with a subsequent filling of a seating material securing the fixing.

* * * * *